United States Patent [19]

Merigaud et al.

[11] Patent Number: 4,977,302

[45] Date of Patent: Dec. 11, 1990

[54] BROWNING UTENSIL FOR MICROWAVE OVENS

[75] Inventors: Bernard Merigaud, Saint-Leonhard-de-Noblat; Michel Claus, Solignac; Robert Passerieux, Limoges, all of France

[73] Assignee: Degussa Aktiengesellschaft, Frankfurt am Main, Fed. Rep. of Germany

[21] Appl. No.: 451,964

[22] Filed: Dec. 20, 1989

[30] Foreign Application Priority Data

Dec. 23, 1988 [EP] European Pat. Off. ..... 88121569.3

[51] Int. Cl.[5] ..... H05B 6/80

[52] U.S. Cl. ..... 219/10.55 E; 219/10.55 F; 426/243; 99/DIG. 14; 126/390

[58] Field of Search ..... 219/10.55 E, 10.55 F, 219/10.55 R; 426/107, 241, 243; 99/DIG. 14; 126/390; 501/6, 14, 15, 16, 17, 21, 32

[56] References Cited

U.S. PATENT DOCUMENTS

| | | | |
|---|---|---|---|
| 3,773,669 | 11/1973 | Yamauchi | 219/10.55 E |
| 3,783,220 | 1/1974 | Tanizaki | 219/10.55 E |
| 3,853,612 | 12/1974 | Spanoudis | 219/10.55 E |
| 3,888,686 | 6/1975 | Ellis | 501/15 |
| 4,341,872 | 7/1982 | MacDowell | 501/6 |
| 4,800,247 | 1/1989 | Schneider et al. | 219/10.55 E |
| 4,822,966 | 4/1989 | Matsubara | 219/10.55 F |

*Primary Examiner*—Philip H. Leung

*Attorney, Agent, or Firm*—Beveridge, DeGrandi & Weilacher

[57] ABSTRACT

A browning utensil for microwave ovens which includes a base member of glass, ceramic or glass-ceramic with a metal containing coating applied to a surface of the base member. Applied over the metal containing coating is a layer of metal-free glazing formed of a glass frit. The metal containing coating also includes a glazing material which preferably is composed of the same ingredients as the metal-free glazing. The glazing material also preferably has essentially the same coefficient of thermal expansion between 20° and 300° C. as the material forming the base member.

14 Claims, 1 Drawing Sheet

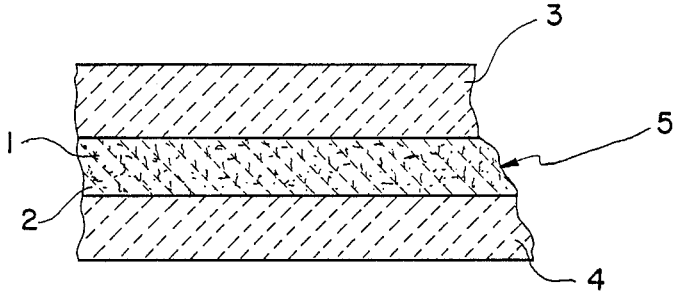
3
5
1
2
4

BROWNING UTENSIL FOR MICROWAVE OVENS

BACKGROUND OF THE INVENTION

This invention relates to a browning utensil for microwave ovens which includes a body member formed of ceramics, glass or glass-ceramics and a metallic coating.

Food is cooked in microwave ovens by the microwaves penetrating into the food from all sides and causing the molecules to oscillate (thermal oscillations). For this reason, only materials that are transparent to microwaves and do not reflect or absorb microwaves are used as cooking utensils. Therefore, as a general matter, only glass, ceramics, glass-ceramics, plastics and paper can be used. Customary metal pots reflect the microwave energy, thus preventing the cooking of the food contained in them.

The surface of the food remains unchanged during cooking in a microwave oven. Therefore, in order to produce a browning crust, so-called browning dishes are used. These dishes, consisting of glass, ceramics or glass-ceramics, are provided, preferably on the bottom, with a special metal alloy which absorbs the microwaves, causing it to become hot in the microwave oven. As a result of this additional heating, the food becomes crispy and brown.

The metal layers previously used for browning dishes have the disadvantage that they reflect a considerable part of the microwave energy and thus do not convert it into thermal energy.

In addition, the adhesion of these metal layers to the dish is poor since the coefficients of thermal expansion of the metals or alloys used and of the bases of glass, ceramics or glass-ceramics are very different.

There is also the danger that the metal layer can be damaged or that metals dissolve into the food if the coating is applied to the interior of the dish.

SUMMARY OF THE INVENTION

The present invention, therefore, is directed at solving the problem of developing a browning utensil for microwave ovens which preferably comprises a main body formed of ceramics, glass or glass-ceramics provided with a metal coating which is a good absorber of microwave energy, adheres well to the supporting base and does no dissolve in foods.

The invention solves this problem in that a layer of a metal-containing glazing is first applied onto the ceramic, glass or glass-ceramic base and then a layer of a metal-free glazing is applied thereover.

The metal-containing layer is preferably composed of 60 to 85% by weight copper, aluminum, iron, nickel, tin, zinc or their alloys in powdered form and of 15 to 40% by weight of a glazing, comprising:

3 to 15% by weight alkali oxide ($Na_2O$, $K_2O$ and/or $Li_2O$)
5 to 20% by weight aluminum oxide
5 to 30% by weight boric oxide
40 to 70% by weight silicon oxide
0 to 10% by weight alkaline-earth oxide
0 to 20% by weight zinc oxide
0 to 15% by weight titanium oxide
0 to 40% by weight zirconium oxide
0 to 10% by weight tin oxide and
0 to 5% by weight fluoride.

It is preferable to use the same glazing for the metal-free protective layer as was used for the metal-containing layer.

The glass frits from which the glazing material is formed are selected in such a manner hereby that they exhibit an optimum coincidence in the coefficients of thermal expansion between 20° and 300° C. with the utensil bases of ceramics, glass or glass-ceramics. With the use of glass-ceramics, which because of their very low thermal expansion coefficient (generally below $20\times10^{-7}$ $K^{-1}$) are well suited for use in browning ware, frits are preferably used with a thermal expansion coefficient in the range of $45\text{–}55\times10^{-7}$ $K^{-1}$. With the application of such frits on a glass-ceramic body, there is avoided the problem of rupture or separation caused by screen pressure with the application of the coatings of the invention.

In the case of glass and ceramic bodies, such qualities come into consideration as will result in low thermal expansion coefficients. For glass and ceramic bodies, frits with a thermal expansion coefficient within the range of 45–60 $\times10^{-7}$ $K^{-1}$ are recommended in achieving optimum coincidence of thermal expansion coefficients. Glass frits having the above-noted properties are well known in the art as illustrated by "Properties of Glass" by George W. Morey, pages 263–294, which is incorporated herein by reference for background purposes.

The layers can be applied by means of known techniques such as screen process printing, offset printing or via transfers (e.g. decals, metachromotypes) onto the base or main body portion of the browning utensil.

BRIEF DESCRIPTION OF THE DRAWING

The FIGURE shows a cross sectional view of a browning utensil according to the invention.

DESCRIPTION

The FIGURE illustrates, in cut away, a cross-sectional view of support body 4 being covered with metal-containing coating 5. Metal-containing coating 5 features a mixture of metal particles 1 dispersed within metal free glazing 2. Metal-containing coating 5 is covered by metal-free glazing 3.

DESCRIPTIVE EXAMPLE

The following examples is intended to explain the invention in more detail:

FIrst, a layer consisting of a paste is applied onto a bowl of glass-ceramics by means of screen process printing, which layer contains 75% by weight zinc powder and 25% by weight of a glass frit consisting of 48.1% $SiO_2$, 19.4% $B_2O_3$, 9.9% $Al_2O_3$, 6.6% ZnO, 5.3% $Li_2O$, 2.0% $ZrO_2$, 5.0% BaO, 1.9% $F_2$, 0.7% MgO, 0.6% $Na_2O$ and 0.5% $TiO_2$. The paste is made of powder and a liquid medium wherein the weight ratio is in the range of 100:40 to 100:80 (powder:liquid). The liquid medium is preferably formed of an oil, particularly turpentine oil and an organic resin which serves as a binder, especially an acrylic resin and can include conventional additives such as, for example, viscosity regulators.

The applied layer is heated at 780° C. in air (approximately 10 minutes) and then the same glass frit without an addition of metal powder is pressed onto the previously applied layer, likewise by means of screen process printing, and heated (780° C.) A temperature of 290° to 300° C., which is sufficient to brown food, is measured in this bowl in a microwave oven after 3 minutes.

European priority patent application No. 88 121 569.3, filed Dec. 23, 1988, is incorporated herein by reference.

Although the present invention has been described with reference to preferred embodiments, the invention is not limited to the specific details thereof. Various substitution and modifications will occur to those of ordinary skill in the art, and all such substitution and modifications are intended to fall within the spirit and scope of the invention as defined in the appended claims.

What is claimed is:

1. A browning utensil for microwave ovens, comprising:

a support base;

a metal-containing coating applied to said support base;

a metal-free glazing applied to said metal-containing coating; and said metal containing coating, at the time of being applied to said support base, being formed of a mixture have 60 to 85% by weight of a metallic material and 15 to 40 % by weight of a non-metallic material.

2. A browning utensil as recited in claim 1, wherein said metal containing coating and said metal-free glazing each are formed from a glass frit having essentially the same coefficient of thermal expansion for temperatures between 20° and 300° C. as that of the support base.

3. A browning utensil as recited in claim 2, wherein said support base is formed of a glass-ceramic material and said glass frit has a thermal expansion coefficient in the range of about $45\text{-}55\times10^{-7}\,K^{-1}$.

4. A browning utensil as recited in claim 2, wherein said support base is a glass and said glass frit has a thermal expansion coefficient in the range of about $45\text{-}60\times10^{-7}\,K^{-1}$.

5. A browning utensil as recited in claim 2, wherein said support base is formed of ceramic and said glass frit has a thermal expansion coefficient in the range of about $45\text{-}60\times10^{-7}\,K^{-1}$.

6. A browning utensil as recited in claim 2, wherein said metal-containing coating includes a non-metallic glazing and said metal-free glazing applied to said metal-containing coating comprises essentially the same ingredients as that of said non-metallic glazing.

7. A browning utensil as recited in claim 1, wherein said metal-containing coating includes a non-metallic glazing and said metal-free glazing applied to said metal-containing coating comprises essentially the same ingredients as that of said non-metallic glazing.

8. A browning utensil as recited in claim 1, wherein said base support is formed of a material essentially transparent to microwaves.

9. A browning utensil as recited in claim 8, wherein said base support is formed of a glass material.

10. A browning utensil as recited in claim 8, wherein said base support is formed of a ceramic material.

11. A browning utensil as recited in claim 8, wherein said base support is formed of a glass-ceramic material.

12. A browning utensil as recited in claim 1, wherein said metallic material is selected from the group consisting of:

(a) copper, (b) aluminum, (c) iron, (d) nickel, (e) tin, (f) zinc, or (g) an alloy containing one or more of (a–f).

13. A browning utensil as recited in claim 12, wherein said non-metallic glazing material is comprised of:

3 to 15% by weight alkali oxide 5 to 20% by weight aluminum oxide 5 to 30% by weight boric oxide 40 to 70% by weight silicon oxide 0 to 10% by weight alkaline-earth oxide 0 to 20% by weight zinc oxide 0 to 15% by weight titanium oxide 0 to 40% by weight zirconium oxide 0 to 10% by weight tin oxide and 0 to 5% by weight fluoride.

14. A browning utensil as recited in claim 1, wherein said metal-free glazing is comprised of:

3 to 15% by weight alkali oxide 5 to 20% by weight aluminum oxide 5 to 30% by weight boric oxide 40 to 70% by weight silicon oxide 0 to 10% by weight alkaline-earth oxide 0 to 20% by weight zinc oxide 0 to 15% by weight titanium oxide 0 to 40% by weight zirconium oxide 0 to 10% by weight tin oxide and 0 to 5% by weight fluoride.

* * * * *